US007385162B2

(12) United States Patent
Ryu et al.

(10) Patent No.: US 7,385,162 B2
(45) Date of Patent: Jun. 10, 2008

(54) HEATER UNIT AND ELECTRIC COOKER EQUIPPED THEREWITH

(75) Inventors: Seung hee Ryu, Anyang-si (KR); Jong Gwan Ryu, Seoul (KR); Eui Sung Kim, Suwon-si (KR); Doo Yong Oh, Seoul (KR); Byeong Wook Park, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 82 days.

(21) Appl. No.: 11/426,024

(22) Filed: Jun. 23, 2006

(65) Prior Publication Data

US 2007/0125766 A1 Jun. 7, 2007

(30) Foreign Application Priority Data

Dec. 2, 2005 (KR) ..... 10-2005-0116818

(51) Int. Cl.
*H05B 6/12* (2006.01)
*H05B 3/68* (2006.01)

(52) U.S. Cl. ..... 219/601; 219/622; 219/624; 219/632; 219/450.1; 99/451

(58) Field of Classification Search ..... 219/620–627, 219/601, 632, 672–677, 443.1, 450.1–452.13; 99/DIG. 14, 451
See application file for complete search history.

(56) References Cited

U.S. PATENT DOCUMENTS 2,515,579 A * 7/1950 Allen ..... 219/454.12
4,468,548 A * 8/1984 Yamaki ..... 219/601
5,136,142 A * 8/1992 Logan ..... 219/454.11
2004/0222217 A1* 11/2004 Yang ..... 219/620
2005/0115959 A1 6/2005 Yang et al.

FOREIGN PATENT DOCUMENTS

| | | |
|---|---|---|
| DE | 1 9500448 | 7/1996 |
| EP | 1487239 | 12/2004 |
| GB | 2223093 | 3/1990 |
| JP | 2004 247186 | 9/2004 |

OTHER PUBLICATIONS

U.S. Appl. No. 11/456,979 to Oh et al., filed Jul. 12, 2006.
U.S. Appl. No. 11/536,722 to Kim et al., filed Sep. 29, 2006.
English language Abstract of JP 2004-247186.
English language Abstract of DE 19500448.

* cited by examiner

*Primary Examiner*—Philip H. Leung
(74) *Attorney, Agent, or Firm*—Greenblum & Bernstein, P.L.C.

(57) ABSTRACT

A heater unit comprises: a hot wire heating unit; an induction heating unit provided adjacent to the hot wire heating unit and operated by induction heating; and connectors each for connecting the hot wire heating unit to the induction heating unit. A cooker comprises: a casing; a heating plate provided on an upper surface of the casing; a hot wire heating unit provided on a bottom surface of the heating plate for generating heat according to application of an electric power; an induction heating unit provided on the bottom surface of the heating plate for being adjacent to the hot wire heating unit and operated by induction heating; connectors each for connecting the hot wire heating unit to the induction heating unit; and support members each provided on the bottom surface of the hot wire heating unit and for supporting the hot wire heating unit.

20 Claims, 4 Drawing Sheets

HEATER UNIT AND ELECTRIC COOKER EQUIPPED THEREWITH

CROSS-REFERENCE TO RELATED APPLICATION

This application claims priority to application filed in the Korean Industrial Property Office on Dec. 2, 2005, and assigned serial No. 10-2005-0116818, the contents of which are incorporated herein by reference.

BACKGROUND

This description relates to a heater unit and an electric cooker equipped therewith, and more particularly to a heater unit and an electric cooker equipped therewith configured for improving a heating efficiency and capable of selectively adopting a heat source as well.

The typical cooker is designed to easily cook food using gas or electricity, and an electric cooker heated by application of electric source has gained in popularity and use.

Particularly, researches are well under way for induction heating used as a major heating source of an electric cooker such as a cooker hob or a cook-top. An electric cooker of induction heating method is such that a high frequency flux is generated if a high frequency current is made to flow in an induction heating coil disposed at a bottom surface of a heating plate, and eddy currents are generated in a cooking vessel disposed on the heating plate by electromagnetic induction of high frequency flux. The cooking vessel is thus heated by generation of Joule heat with regard to resistance components thereof.

The electric cooker thus explained has an advantage of an excellent heating efficiency while it has a disadvantage in that only the cooking vessel of magnetic attribute is heated.

Researches are being vigorously conducted recently to overcome the disadvantage of the cooking vessel, and as a result, induction heated electric cookers have been developed for heating cooking vessels of magnetic attribute and cooking vessels of non-magnetic attribute as well. However, it is necessary to increase an operation frequency of the non-magnetic electric cooker, or to increase the current and the number of turns of induction heating coils for the non-magnetic cooking vessel, for achievement of the same heating effect as that of the magnetic cooking vessels, because of less magnetic permeability than that of the magnetic cooker.

There is a disadvantage in the electric cooker thus mentioned in that configuration tends to be relatively complicated due to involvement with a heater and an inverter for heating the non-magnetic cooking vessel, entailing more economic burden resulting therefrom. This results in decrease in assembling efficiency of electric cookers and increase in unit price of the product.

There is further disadvantage in that non-magnetic cooking vessels made of such material, for example, ceramic or glass, are hard to be applied with aforementioned techniques although the improvement can be applied to magnetic/non-magnetic metal cooking vessels.

SUMMARY

The present invention is disclosed to solve the aforementioned disadvantages or problems, and it is an object of the present invention to provide a heater unit and an electric cooker equipped therewith configured for use both in magnetic and non-magnetic cooking vessels with improvement in heating efficiency.

In one general aspect, the heater unit comprises: a hot wire heating unit; an induction heating unit provided adjacent to the hot wire heating unit and operated by induction heating; and connectors each for connecting the hot wire heating unit to the induction heating unit.

Preferably, the hot wire heating unit wraps an external side of the induction heating unit and is spaced a predetermined distance apart from the induction heating unit.

Preferably, the hot wire heating unit comprises: a reflection plate formed with a hollow part in which the induction heating unit can be disposed; and a hot wire heater provided on the reflection plate. Preferably, the reflection plate is formed with heater through holes through which terminals can pass and be coupled thereto. Preferably, the hot wire heater is a carbon heater.

In another general aspect, the electric cooker equipped with the heater unit comprises: a casing; a heating plate provided on an upper surface of the casing; a hot wire heating unit provided on a bottom surface of the heating plate for generating heat according to application of an electric power; an induction heating unit provided on the bottom surface of the heating plate for being adjacent to the hot wire heating unit and operated by induction heating; connectors each for connecting the hot wire heating unit to the induction heating unit; and support members each provided on the bottom surface of the hot wire heating unit and for supporting the hot wire heating unit.

Preferably, the hot wire heating unit wraps an external side of the induction heating unit and is spaced a predetermined distance apart from the induction heating unit.

Preferably, the hot wire heating unit comprises: a reflection plate formed with a hollow part in which the induction heating unit can be disposed; and a hot wire heater provided on the reflection plate. Preferably, the reflection plate is formed with heater through holes through which terminals can pass and be coupled thereto. Preferably, the hot wire heater is a carbon heater.

Preferably, the support members are composed of elastic material and elastically support the reflection plate. Preferably, the support members are springs.

In still another general aspect, the electric cooker equipped with the heater unit comprises: a casing; a heating plate provided on an upper surface of the casing; a hot wire heating unit provided on a bottom surface of the heating plate for generating heat according to application of an electric power; an induction heating unit provided on the bottom surface of the heating plate for being adjacent to the hot wire heating unit and operated by induction heating; a first support member provided on the bottom surface of the hot wire heating unit and for supporting the hot wire heating unit; and a second support member provided on the bottom surface of the induction heating unit and supporting the induction heating unit.

Preferably, the hot wire heating unit wraps an external side of the induction heating unit and is spaced a predetermined distance apart from the induction heating unit.

Preferably, the hot wire heating unit comprises: a reflection plate formed with a hollow part in which the induction heating unit can be disposed; and a hot wire heater provided on the reflection plate. Preferably, the reflection plate is formed with heater through holes through which terminals can pass and be coupled thereto. Preferably, the hot wire heater is a carbon heater.

Preferably, the induction heating unit comprises: a base plate; a first insulation tape attached to an upper surface of the base plate; a ferrite core provided on an upper surface of the first insulation tape; a second ferrite core provided on an upper surface of the ferrite core; and an induction heating coil attached on an upper surface of the second insulation tape.

Preferably, the first and second support members are made of elastic material, and the first support member elastically supports the reflection plate, and the second support member elastically supports the base plate. Preferably, the first and second support members are springs.

DETAILED DESCRIPTION

Figure 1:
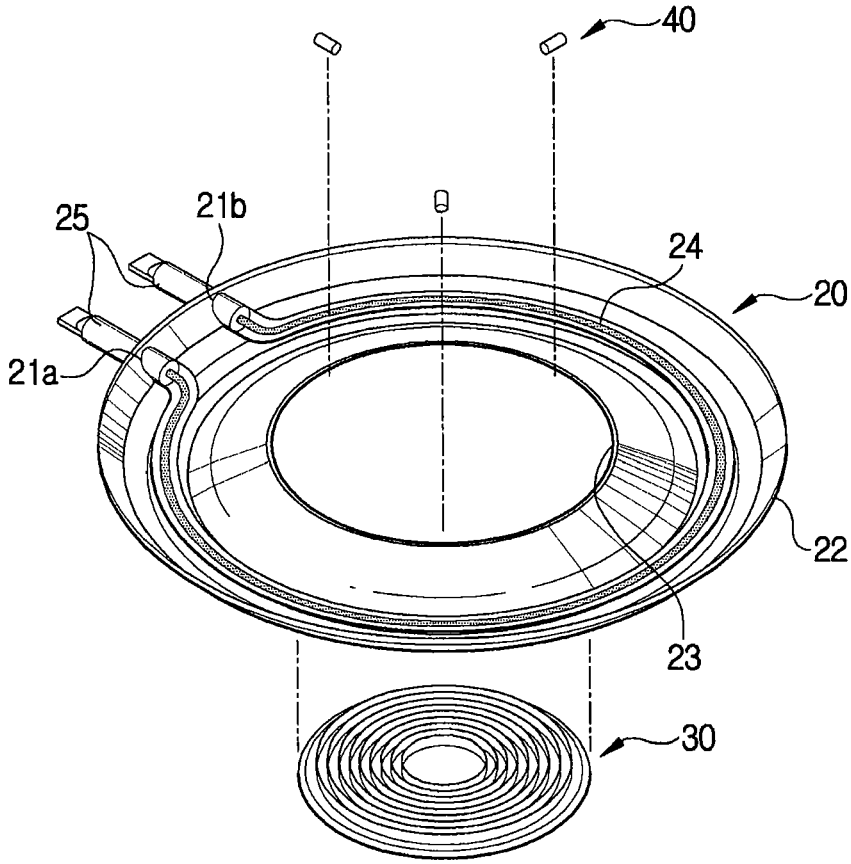
FIG. 1 is an exploded perspective view of a heater unit according to the present invention.
Figure 2:
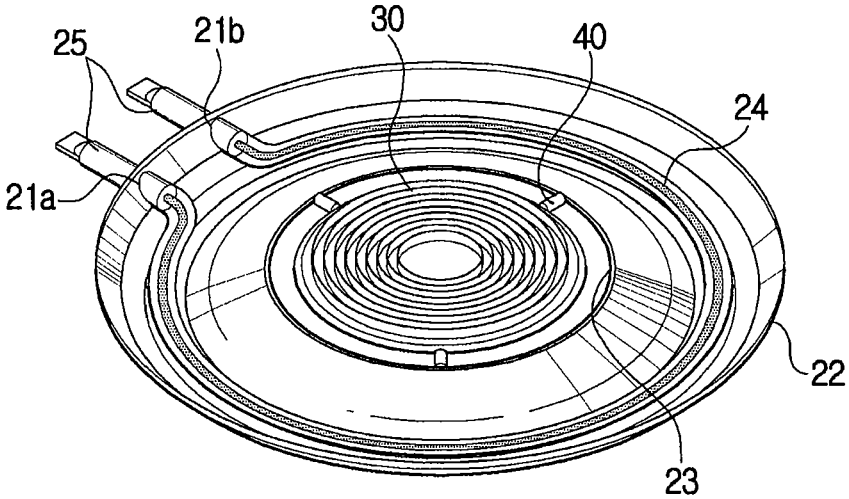
FIG. 2 is a coupled perspective view of FIG.1.
Figure 3:
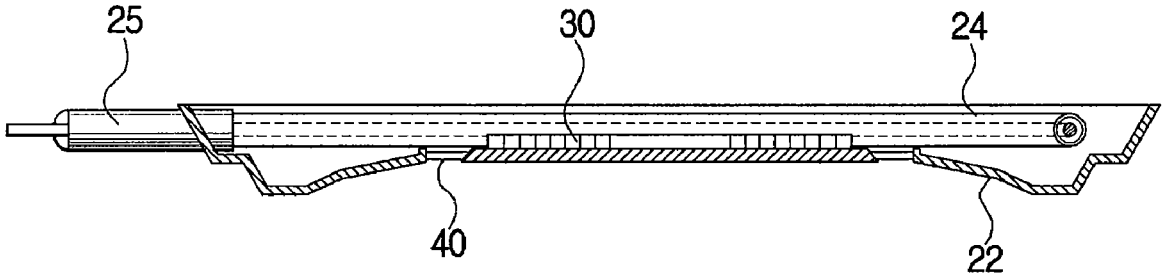
FIG. 3 is a cross-sectional view of a heater unit according to the present invention.

Referring to FIGS. 1 to 3, a heater unit according to the present invention comprises: a hot wire heating unit 20; an induction heating unit 30 provided adjacent to the hot wire heating unit 20 and operated by induction heating; and connectors 40 each for connecting the hot wire heating unit 20 to the induction heating unit 30.

The hot wire heating unit 20 wraps an external side of the induction heating unit 30 and is spaced a predetermined distance apart from the induction heating unit 30, and each connector is disposed at a space formed by the hot wire heating unit 20 and the induction heating unit 30.

As a result, the hot wire heating unit 20 and the induction heating unit 30 are interconnected. In other words, the hot wire heating unit 20 and the induction heating unit 30 are integrally connected.

The hot wire heating unit 20 comprises: a disc-shaped reflection plate 22 formed with a hollow part 23; and a hot wire heater 24 provided on the reflection plate 22 and formed with terminals 25 at both ends thereof.

The reflection plate 22 designed for improving heat efficiency of the hot wire heater 24 is formed with heater through holes 21*a* and 21*b* through which terminals 25 of the hot wire heater 24 passes and are coupled thereto. The hollow part 23 is disposed with the induction heating unit 30. The reflection plate 22 may come in various structures and materials.

The hot wire heater 24 of ring-shape is heated by application of a power source from the terminals 25, and although it is preferred that the hot wire heater 24 be a carbon heater having an excellent heat generation, it should be apparent that other various kinds of heaters including a radiant heater may be selectively used if necessary.

The induction heating unit 30 is operated by induction heating, where the term "induction heating" generally describes a process in which an alternating current is passed through a coil to generate an alternating magnetic flux. When the coil is placed in close proximity to or wrapped around a metallic object that is to be heated, the alternating magnetic flux inductively couples the load to the coil and generates eddy currents within the metallic object causing it to become heated. Because of its function, the coil, which is the induction heating unit 30 in the present invention having a round plate shape, is typically referred to as a "work coil" or "working coil".

A total of three connectors 40, each of a bar shape, are disposed for stably maintaining a connected state between the hot wire heating unit 20 and the induction heating unit 30, each connector spaced a predetermined distance apart. The connectors may be appropriately adjustable in shapes, sizes, numbers and positions, and various known materials may be selectively used based on high durability and strength for the connectors.

Arrangement of the hot wire heating unit 20 and the induction heating unit 30 may be changed as needed. For example, although it is described that the hot wire heating unit 20 wraps an external side of the induction heating unit 30 and is spaced a predetermined distance apart from the induction heating unit 30, it should be apparent that conversely, the induction heating unit 30 wraps an external side of the hot wire heating unit 20 and is spaced a predetermined distance apart from the hot wire heating unit 20.

The hot wire heating unit 20 can heat both the magnetic body and non-magnetic body, while the induction heating unit 30 can heat the magnetic body only. Consequently, the hot wire heating unit 20 and the induction heating unit 30 may be selectively used with respect to the material of a cooking vessel. Meanwhile, in heating a magnetic body, it is preferred that the induction heating unit 30 be used over the hot wire heating unit 20.

Figure 4:
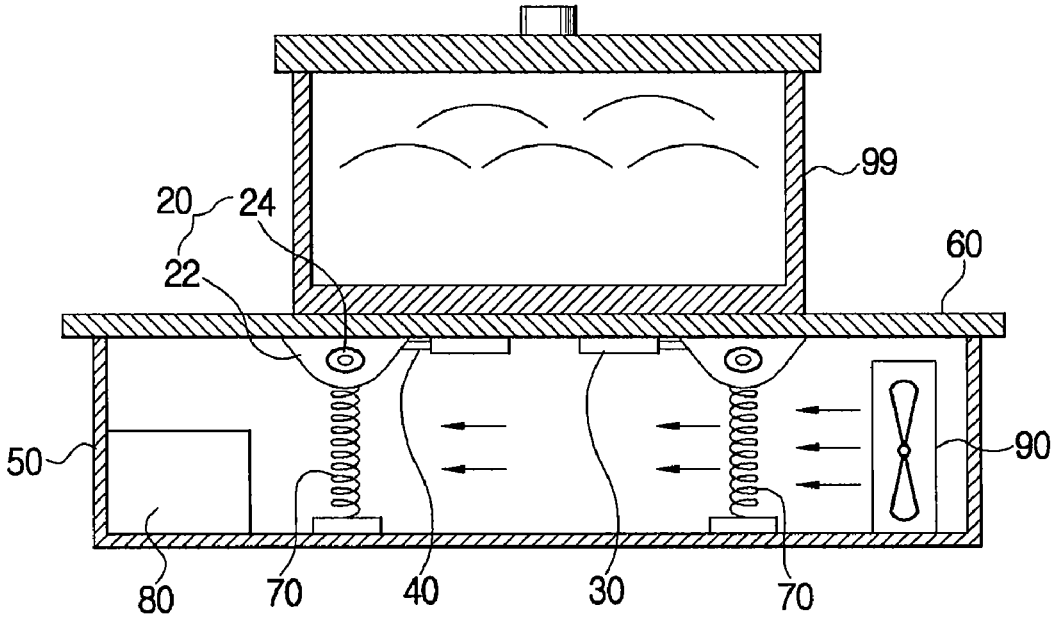
FIG. 4 is a schematic cross-sectional view of an electric cooker equipped with a heater unit according to a first embodiment of the present invention.

FIG. 4 is a schematic cross-sectional view of an electric cooker equipped with a heater unit according to a first embodiment of the present invention, where the heater unit is the same as that of FIGS. 1 to 3, such that description will be made by way of the heater unit thereof.

An electric cooker equipped with a heater unit according to the present invention comprises: a casing 50; a heating plate 60 provided on an upper surface of the casing 50; a hot wire heating unit 20 provided on a bottom surface of the heating plate 60 for generating heat according to application of an electric power; an induction heating unit 30 provided on the bottom surface of the heating plate 60 for being adjacent to the hot wire heating unit 20 and operated by induction heating; connectors 40 each for connecting the hot wire heating unit 20 to the induction heating unit 30; and support members 70 each provided on the bottom surface of the hot wire heating unit 20 and for supporting the hot wire heating unit 20.

The casing 50 is disposed therein with an inverter unit 80 and a cooling fan 90 for cooling the induction heating unit 30. It is preferred that the induction heating unit 30 in the casing 50 be cooled by the cooling fan 90 to a predetermined temperature in order to appropriately maintain an inner temperature of the casing 50 because the induction heating unit 30 has a limit in its capacity of heat-resistance.

The heating plate 60, which is heated by the hot wire heating unit 20 and/or the induction heating unit 30, serves to support and heat a cooking vessel 99.

Particularly, the induction heating unit 30 is operated in such a manner that high frequency current is made to flow in the heating plate 60 to generate high frequency magnetic flux, and the high frequency magnetic flux causes to generate eddy currents within the heating plate 60 by way of electromagnetic induction of high frequency flux. The cooking vessel 99 is thus heated by generation of Joule's heat with regard to resistance components thereof.

The hot wire heating unit 20 wraps an external side of the induction heating unit 30 and is spaced a predetermined distance apart from the induction heating unit 30, and each connector is disposed at a space formed by the hot wire heating unit 20 and the induction heating unit 30.

As a result, the hot wire heating unit 20 and the induction heating unit 30 are interconnected. In other words, the hot wire heating unit 20 and the induction heating unit 30 are integrally connected.

The hot wire heating unit 20 comprises: a disc-shaped reflection plate 22 formed with a hollow part 23; and a hot wire heater 24 provided on the reflection plate 22 and formed with terminals 25 at both ends thereof.

The reflection plate 22 designed for improving heat efficiency of the hot wire heater 24 is formed with heater through holes 21*a* and 21*b* through which terminals 25 of the hot wire heater 24 passes and are coupled thereto. The hollow part 23 is disposed with the induction heating unit 30. The reflection plate 22 may come in various structures and materials.

The hot wire heater 24 of ring-shape is heated by application of a power source from the terminals 25, and although it is preferred that the hot wire heater 24 be a carbon heater having an excellent heat generation, it should be apparent that other various kinds of heaters including a radiant heater may be selectively used if necessary.

The induction heating unit 30 is operated by induction heating, where the term induction heating generally describes a process in which temperature of a metallic object is heated by electric energy converted from induction heating coil. Because of its function, the coil, which is the induction heating unit 30 in the present invention, having a round plate shape, is typically referred to as a "work coil" or "working coil".

A total of three connectors 40, each of a bar shape, are disposed for stably maintaining a connected state between the hot wire heating unit 20 and the induction heating unit 30, each connector spaced a predetermined distance apart. The connectors may be appropriately adjustable in shapes, sizes, numbers and positions, and various known materials may be selectively used based on high durability and strength for the connectors.

Arrangement of the hot wire heating unit 20 and the induction heating unit 30 may be changed as needed. For example, although it is described that the hot wire heating unit 20 wraps an external side of the induction heating unit 30 and is spaced a predetermined distance apart from the induction heating unit 30, it should be apparent that conversely, the induction heating unit 30 wraps an external side of the hot wire heating unit 20 and is spaced a predetermined distance apart from the hot wire heating unit 20.

The hot wire heating unit 20 can heat both the magnetic body and non-magnetic body, while the induction heating unit 30 can heat the magnetic body only. Consequently, the hot wire heating unit 20 and the induction heating unit 30 may be selectively used with respect to the material of a cooking vessel. Meanwhile, in heating a magnetic body, it is preferred that the induction heating unit 30 be used over the hot wire heating unit 20.

The support members 70 are composed of elastic material and elastically support the reflection plate 22. The support members 70 may include various kinds of known elastic materials such as springs and the like, as long as the support members 70 stably support the reflection plate 22.

The electric cooker is operated in such a fashion that a resonant current flowing in the induction heating unit 30 is detected to discriminate whether the cooking vessel 99 on the heating plate 60 is a magnetic body or a non-magnetic body, and to appropriately turn on/off the hot wire heating unit 20 and the induction heating unit 30 with respect to the kind of the cooking vessel 99.

For example, if the cooking vessel 99 is a magnetic body, the hot wire heating unit 20 and the induction heating unit 30 are simultaneously driven, and if the cooking vessel 99 is a non-magnetic body, only the hot wire heating unit 20 is independently driven.

Figure 5:
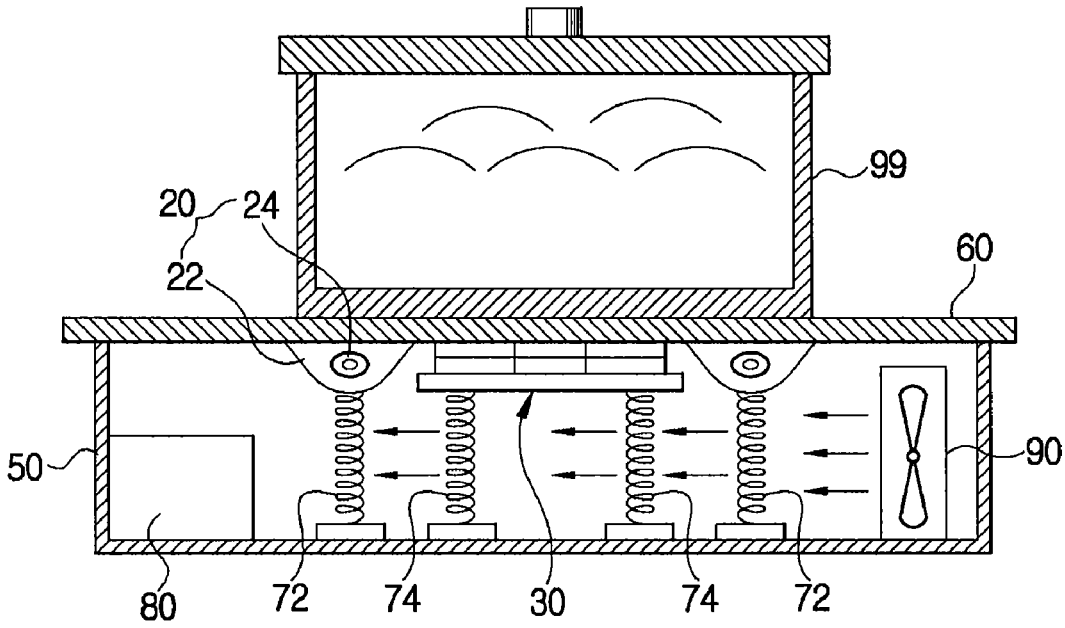
FIG. 5 is a schematic cross-sectional view of an electric cooker equipped with a heater unit according to a second embodiment of the present invention.
Figure 6:
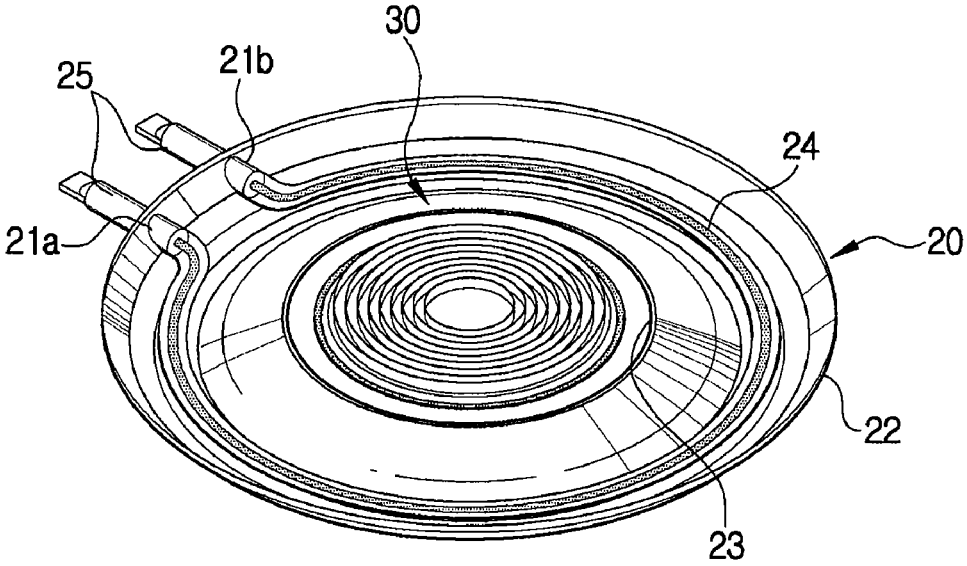
FIG. 6 is a perspective view of the heater unit of FIG.5.
Figure 7:
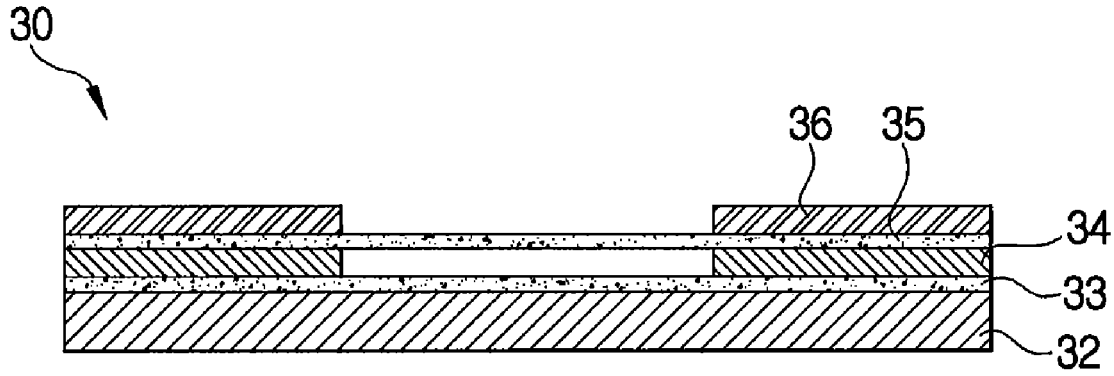
FIG. 7 is a cross-sectional view of the heater unit of FIG.5.

Now, referring to FIGS. 5 to 7, an electric cooker equipped with a heater unit comprises: a casing 50; a heating plate 60 provided on an upper surface of the casing 50; a hot wire heating unit 20 provided on a bottom surface of the heating plate 60 for generating heat according to application of an electric power; an induction heating unit 30 provided on the bottom surface of the heating plate 60 for being adjacent to the hot wire heating unit 20 and operated by induction heating; a first support member 72 provided on the bottom surface of the hot wire heating unit 20 and for supporting the hot wire heating unit 20; and a second support member 74 provided on the bottom surface of the induction heating unit 30 and supporting the induction heating unit 30.

The casing 50 is disposed therein with an inverter unit 80 and a cooling fan 90 for cooling the induction heating unit 30. It is preferred that the induction heating unit 30 in the casing 50 be cooled by the cooling fan 90 to a predetermined temperature in order to appropriately maintain an inner temperature of the casing 50 because the induction heating unit 30 has a limit in its capacity of heat-resistance.

The heating plate 60, which is heated by the hot wire heating unit 20 and/or the induction heating unit 30, serves to support and heat a cooking vessel 99.

Particularly, the induction heating unit 30 is operated in such a manner that high frequency current is made to flow in the heating plate 60 to generate high frequency magnetic flux, and the high frequency magnetic flux causes to generate eddy currents within the heating plate 60 by way of electromagnetic induction of high frequency flux. The cooking vessel 99 is thus heated by generation of Joule heat with regard to resistance components thereof.

The hot wire heating unit 20 wraps an external side of the induction heating unit 30 and is spaced a predetermined distance apart from the induction heating unit 30, and each connector is disposed at a space formed by the hot wire heating unit 20 and the induction heating unit 30.

As a result, the hot wire heating unit 20 and the induction heating unit 30 are interconnected. In other words, the hot wire heating unit 20 and the induction heating unit 30 are integrally connected.

The hot wire heating unit 20 comprises: a disc-shaped reflection plate 22 formed with a hollow part 23; and a hot wire heater 24 provided on the reflection plate 22 and formed with terminals 25 at both ends thereof.

The reflection plate 22 designed for improving heat efficiency of the hot wire heater 24 is formed with heater through holes 21*a* and 21*b* through which terminals 25 of the hot wire heater 24 passes and are coupled thereto. The hollow part 23 is disposed with the induction heating unit 30. The reflection plate 22 may come in various structures and materials.

The hot wire heater 24 of ring-shape is heated by application of a power source from the terminals 25, and although it is preferred that the hot wire heater 24 be a carbon heater having an excellent heat generation, it should be apparent that other various kinds of heaters including a radiant heater may be selectively used if necessary.

The induction heating unit 30 is operated by induction heating, where the induction heating generally describes a process in which temperature of a metallic object is heated by electric energy converted from induction heating coils.

The induction heating unit comprises: a base plate 32; a first insulation tape 33 attached to an upper surface of the base plate 32; a ferrite core 34 provided on an upper surface of the first insulation tape 33; a second ferrite core 35 provided on an upper surface of the ferrite core 34; and an induction heating coil 36 attached on an upper surface of the second insulation tape 35.

The base plate 32, which is made of aluminum material, prevents the magnetic force transmitted from the induction heating coil 36 from moving downwards to thereby enhance a pass efficiency of the magnetic flux. The induction heating coil 36 is typically called a work coil or a working coil.

The first and second insulation tapes 33 and 35 function to support the ferrite core 34.

Arrangement of the hot wire heating unit 20 and the induction heating unit 30 may be changed as needed. For example, although it is described that the hot wire heating unit 20 wraps an external side of the induction heating unit 30 and is spaced a predetermined distance apart from the induction heating unit 30, it should be apparent that conversely, the induction heating unit 30 wraps an external side of the hot wire heating unit 20 and is spaced a predetermined distance apart from the hot wire heating unit 20.

The hot wire heating unit 20 can heat both the magnetic body and non-magnetic body, while the induction heating unit 30 can heat the magnetic body only. Consequently, the hot wire heating unit 20 and the induction heating unit 30 may be selectively used with respect to the material of a cooking vessel. Meanwhile, in heating a magnetic body, it is preferred that the induction heating unit 30 be used over the hot wire heating unit 20.

The first and second support members 72 and 74 are composed of elastic material, and the first support member 72 elastically supports the reflection plate 22. The second support member 74 elastically supports the base plate 32. The first and second support members 72 and 74 may include various kinds of known elastic materials such as springs and the like, as long as the first and second support members 72 and 74 stably support the reflection plate 22 and the base plate 32.

As apparent from the foregoing, there are advantages in the heater unit and the electric cooker equipped therewith thus described in that a hot wire heating unit and an induction heating unit can be selectively used in respect of material of a cooking vessel to enable to improve heating efficiency of the heater unit, and to easily cook food free from the kind of the cooking vessel. As a result, functionality and usability of the electric cooker can be further improved. Furthermore, the heater unit can be structurally integrated to thereby enable to improve productivity and assemblage.

Although the embodiments of the present invention have been shown and described, the present invention is not limited to the described embodiments. Instead, it would be appreciated by those skilled in the art that various changes may be made to the embodiments without departing from the principles and spirit of the invention, the scope of which is defined by the claims and their equivalents.

What is claimed is:

1. A heater unit comprising:

a hot wire heating unit;

an induction heating unit provided adjacent to the hot wire heating unit and operated by induction heating, the induction heating unit comprising a substantially planar shape defined by a perimeter;

the hot wire heating unit being positioned so as to encircle the perimeter of the induction heating unit; and connectors each connecting the hot wire heating unit to the induction heating unit.

2. The unit as defined in claim 1, wherein the hot wire heating unit is spaced a predetermined distance apart from the induction heating unit.

3. The unit as defined in claim 2, wherein the hot wire heating unit comprises:

a reflection plate formed with a hollow part in which the induction heating unit can be disposed; and a hot wire heater provided on the reflection plate.

4. The unit as defined in claim 3, wherein the hot wire heater is a carbon heater.

5. The unit as defined in claim 2, wherein the reflection plate is formed with heater through holes through which terminals can pass and be coupled thereto.

6. An electric cooker equipped with a heater unit comprising:

a casing;

a heating plate provided on an upper surface of the casing;

a hot wire heating unit provided on a bottom surface of the heating plate to generate heat according to application of electric power;

an induction heating unit provided on the bottom surface of the heating plate to be adjacent to the hot wire heating unit and operated by induction heating, the induction heating unit comprising a substantially planar shape defined by a perimeter;

the hot wire heating unit being positioned so to encircle the perimeter of the induction heating unit;

connectors each connecting the hot wire heating unit to the induction heating unit; and support members each provided on the bottom surface of the hot wire heating unit and supporting the hot wire heating unit.

7. The cooker as defined in claim 6, wherein the hot wire heating unit is spaced a predetermined distance apart from the induction heating unit.

8. The cooker as defined in claim 7, wherein the hot wire heating unit comprises:

a reflection plate formed with a hollow part in which the induction heating unit can be disposed; and a hot wire heater provided on the reflection plate.

9. The cooker as defined in claim 8, wherein the reflection plate is formed with heater through holes through which terminals can pass and be coupled thereto.

10. The cooker as defined in claim 8, wherein the hot wire heater is a carbon heater.

11. The cooker as defined in claim 6, wherein the support members are composed of elastic material and elastically support the reflection plate.

12. The cooker as defined in claim 11, wherein the support members are springs.

13. An electric cooker equipped with a heater unit comprising:

a casing;

a heating plate provided on an upper surface of the casing;

a hot wire heating unit provided on a bottom surface of the heating plate to generate heat according to application of electric power;

an induction heating unit provided on the bottom surface of the heating plate to be adjacent to the hot wire heating unit and operated by induction heating, the induction heating unit comprising a substantially planar shape defined by a perimeter;

the hot wire heating unit being positioned so as to encircle the perimeter of the induction heating unit;

a first support member provided on the bottom surface of the hot wire heating unit and supporting the hot wire heating unit; and a second support member provided on the bottom surface of the induction heating unit and supporting the induction heating unit.

14. The cooker as defined in claim 13, wherein the hot wire heating unit is spaced a predetermined distance apart from the induction heating unit.

15. The cooker as defined in claim 14, wherein the hot wire heating unit comprises:

a reflection plate formed with a hollow part in which the induction heating unit can be disposed; and a hot wire heater provided on the reflection plate.

16. The cooker as defined in claim 15, wherein the reflection plate is formed with heater through holes through which terminals can pass and be coupled thereto.

17. The cooker as defined in claim 15, wherein the hot wire heater is a carbon heater.

18. The cooker as defined in claim 13, wherein the induction heating unit comprises:

a base plate;

a first insulation tape attached to an upper surface of the base plate;

a ferrite core provided on an upper surface of the first insulation tape;

a second ferrite core provided on an upper surface of the ferrite core; and an induction heating coil attached on an upper surface of the second insulation tape.

19. The cooker as defined in claim 13, wherein the first and second support members are made of elastic material, and wherein the first support member elastically supports the reflection plate, and the second support member elastically supports the base plate.

20. The cooker as defined in claim 19, wherein the first and second support members are springs.

* * * * *